US009302193B2

(12) United States Patent
Chang et al.

(10) Patent No.: US 9,302,193 B2
(45) Date of Patent: Apr. 5, 2016

(54) CORNER BOOSTER FOR TOY VEHICLE TRACK SET

(75) Inventors: Kin Fai Chang, Hong Kong (CN); Louis Luk Kwok Yau, Hong Kong (CN)

(73) Assignee: Mattel, Inc., El Segundo, CA (US)

( * ) Notice: Subject to any disclaimer, the term of this patent is extended or adjusted under 35 U.S.C. 154(b) by 1606 days.

(21) Appl. No.: 12/613,571

(22) Filed: Nov. 6, 2009

(65) Prior Publication Data

US 2010/0112896 A1 May 6, 2010

Related U.S. Application Data

(63) Continuation of application No. PCT/US2008/062886, filed on May 7, 2008.

(30) Foreign Application Priority Data

May 8, 2007 (CN) ..... 2007 1 0102985
Feb. 1, 2008 (CN) ..... 2008 1 0009412

(51) Int. Cl.
*A63H 29/00* (2006.01)
*A63H 18/02* (2006.01)

(52) U.S. Cl.
CPC ..... *A63H 18/028* (2013.01); *A63H 18/026* (2013.01)

(58) Field of Classification Search
CPC ..... A63H 17/008; A63H 18/028
USPC ..... 446/444, 429
See application file for complete search history.

(56) References Cited

U.S. PATENT DOCUMENTS

| | | | |
|---|---|---|---|
| 1,758,032 | A | 5/1930 | Dickman |
| 2,193,687 | A | 3/1940 | Flinn |
| 3,011,288 | A | 12/1961 | Einfalt |
| 3,590,524 | A | 7/1971 | Beny et al. |
| 3,599,365 | A | 8/1971 | Carver |

(Continued)

FOREIGN PATENT DOCUMENTS

| | | | |
|---|---|---|---|
| CN | 2089356 | U | 11/1991 |
| CN | 2310871 | Y | 3/1999 |

(Continued)

OTHER PUBLICATIONS

International Search Report and Written Opinion from Application No. PCT/US2008/062886, dated Aug. 29, 2008 (10 pages).

(Continued)

*Primary Examiner* — Michael Dennis
*Assistant Examiner* — Urszula M Cegielnik
(74) *Attorney, Agent, or Firm* — Edell, Shapiro & Finnan, LLC

(57) ABSTRACT

A corner booster for accelerating toy vehicles includes an entrance to which a toy vehicle enters the booster, and an exit from which the toy vehicle exits the booster. The entrance and exit are orientated so that the toy vehicle turns when traveling from the entrance to the exit. The corner booster further includes a booster member for applying a force to the toy vehicle. The force applied by the booster member increases the speed of the toy vehicle as the toy vehicle travels from the entrance to the exit. The corner booster includes a cocking mechanism that cocks the booster member with preloaded mechanical energy. The preloaded mechanical energy is used to move the booster member to apply the boosting force to the toy vehicle.

30 Claims, 7 Drawing Sheets

(56) References Cited

U.S. PATENT DOCUMENTS

| | | | | | |
|---|---|---|---|---|---|
| 3,600,849 | A | | 8/1971 | Faller | |
| 3,600,850 | A | | 8/1971 | Summerfield | |
| 3,641,704 | A | | 2/1972 | Sims et al. | |
| 3,768,810 | A | | 10/1973 | Goldfarb | |
| 3,798,832 | A | | 3/1974 | Terzian | |
| 3,877,169 | A | | 4/1975 | Munday et al. | |
| 3,908,303 | A | | 9/1975 | McKay et al. | |
| 3,998,460 | A | | 12/1976 | Dyer | |
| 4,007,933 | A | * | 2/1977 | Cooper | 273/445 |
| 4,016,674 | A | | 4/1977 | Resnick et al. | |
| 4,203,247 | A | | 5/1980 | Moe et al. | |
| 4,220,130 | A | | 9/1980 | Glover et al. | |
| 4,266,769 | A | | 5/1981 | Saitoh | |
| 4,267,661 | A | | 5/1981 | Hanson | |
| 4,433,504 | A | | 2/1984 | Terui | |
| 4,475,303 | A | | 10/1984 | Ribas et al. | |
| 4,504,242 | A | | 3/1985 | Crain et al. | |
| 4,511,342 | A | | 4/1985 | Hart et al. | |
| 4,564,197 | A | | 1/1986 | Lambert et al. | |
| 4,642,066 | A | | 2/1987 | Kennedy et al. | |
| 4,715,843 | A | * | 12/1987 | Ostendorff et al. | 446/444 |
| 4,799,916 | A | * | 1/1989 | McKay et al. | 446/444 |
| D305,044 | S | | 12/1989 | Klitsner | |
| 4,925,188 | A | | 5/1990 | McKay et al. | |
| 5,052,972 | A | | 10/1991 | Suimon et al. | |
| 5,254,030 | A | | 10/1993 | Ostendorff et al. | |
| 5,417,196 | A | | 5/1995 | Morrison et al. | |
| 5,813,391 | A | | 9/1998 | Johnson | |
| 5,823,848 | A | | 10/1998 | Cummings | |
| 5,857,451 | A | | 1/1999 | Ciluffo et al. | |
| 5,899,789 | A | | 5/1999 | Rehkemper et al. | |
| 6,000,992 | A | | 12/1999 | Lambert | |
| 6,062,942 | A | | 5/2000 | Ogihara | |
| 6,089,951 | A | * | 7/2000 | Ostendorff | 446/444 |
| 6,241,573 | B1 | * | 6/2001 | Ostendorff et al. | 446/444 |
| 6,435,929 | B1 | * | 8/2002 | Halford | 446/444 |
| 6,637,422 | B2 | | 10/2003 | Wojtkiewicz et al. | |
| 6,695,675 | B1 | | 2/2004 | Ngan | |
| 6,793,554 | B1 | | 9/2004 | Newbold | |
| 7,819,720 | B2 | * | 10/2010 | Nuttall et al. | 446/444 |
| 2005/0287915 | A1 | * | 12/2005 | Sheltman et al. | 446/444 |
| 2009/0117821 | A1 | | 5/2009 | Ogihara | |

FOREIGN PATENT DOCUMENTS

| | | | |
|---|---|---|---|
| CN | 2787280 | Y | 6/2006 |
| CN | 101032670 | A | 9/2007 |

OTHER PUBLICATIONS

Office Action and English Translation of the Office Action from Chinese Patent Application No. 2007101004777 (Chinese Publication No. CN101032670), dated Jun. 26, 2009 (9 pages).

* cited by examiner

CORNER BOOSTER FOR TOY VEHICLE TRACK SET

CROSS-REFERENCE TO RELATED APPLICATIONS

This application is a continuation of PCT Application Serial No. PCT/US2008/062886, entitled "Corner Booster for Toy Vehicle Track Set", filed May 7, 2008, which was published as International Publication No. WO 2008/141037A1 on Nov. 20, 2008, which claims priority to Chinese Patent Application No. 200710102985.9, filed May 8, 2007, and Chinese Patent Application No. 200810009412.6, filed Feb. 1, 2008, the disclosure of each of which is incorporated by reference herein in its entirety.

BACKGROUND

Toy vehicle track sets may include one or more track sections arranged to form a path around which one or more toy vehicles can travel. The toy vehicles may be either self-powered or receive power from an external source. Devices used to accelerate unpowered toy vehicles around a track are often referred to as boosters.

Boosters typically include a pair of motor-driven rotating wheels flanking a linear portion of the track. As a vehicle passes between the booster wheels, the rotating wheels temporarily engage the sides of the toy vehicle and accelerate the toy vehicle forward.

Typical booster wheels suffer from several problems. Typical booster motors constantly work to keep the booster wheels spinning at all times. This can waste a substantial amount of energy. As such, typical boosters that are powered by batteries may require frequent battery changes. Furthermore, typical boosters accelerate toy vehicles over a linear portion of the track and are incapable of accelerating a toy vehicle around a corner of the track. Furthermore, because typical boosters engage the sides of a toy vehicle, they may not perform well with toy vehicles that have irregularly shaped sides.

SUMMARY

A corner booster for a toy vehicle track set is provided. The corner booster includes an entrance to which a toy vehicle enters the booster, and an exit from which the toy vehicle exits the booster. The entrance and exit are orientated so that the toy vehicle turns when traveling from the entrance to the exit. The corner booster further includes a booster member for applying a force to the toy vehicle. The force applied by the booster member increases the speed of the toy vehicle as the toy vehicle travels from the entrance to the exit. The corner booster includes a cocking mechanism that cocks the booster member with preloaded mechanical energy. The preloaded mechanical energy is used to move the booster member to apply the boosting force to the toy vehicle.

DESCRIPTION

Figure 1:
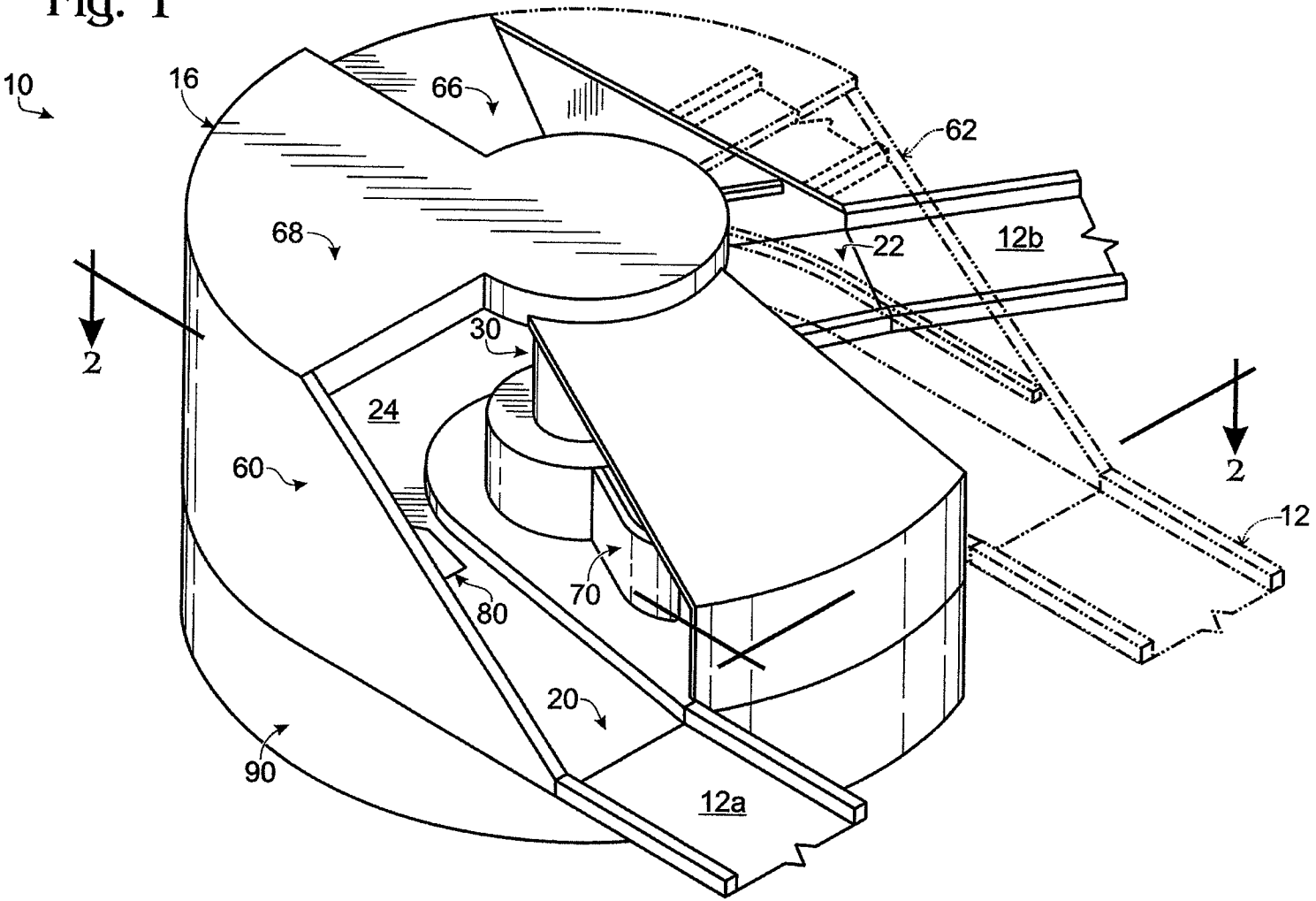
FIG. 1 shows a portion of a toy vehicle track set including a corner booster for accelerating toy vehicles around a corner of a track.

FIG. 1 shows a portion of an exemplary toy vehicle track set 10. Track set 10 includes one or more track segments 12 on which a toy vehicle can travel. Track set 10 also includes a corner booster 16 that accelerates toy vehicles over the track. For the sake of simplicity, FIG. 1 shows only the portion of the track in close proximity to corner booster 16. In particular, FIG. 1 shows an inbound section 12*a* of track leading to corner booster 16 and an outbound section 12*b* of track leading away from corner booster 16. It should be understood that virtually any number of different track designs may be used without departing from the scope of this disclosure. Such designs include closed loop tracks and open tracks. Furthermore, while FIG. 1 shows only a single corner booster, it should be understood that virtually any combination of corner boosters and linear boosters can be used with the same track set.

Corner booster 16 includes an entrance 20 to which a toy vehicle enters the booster from the inbound section of the track. The booster also includes an exit 22 from which the toy vehicle exits the booster to the outbound section of the track. The booster further includes a curved portion 24 intermediate the entrance and the exit. The curved portion of the corner booster directs a toy vehicle through a turn as it travels from the entrance to the exit.

The entrance and the exit may include rolling surfaces that align with the inbound and outbound sections of the track, respectively. In this way, a toy vehicle can easily travel from the inbound section of the track to the entrance, and then from the exit to the outbound section of the track. The entrance, exit, and/or curved portion may optionally include sidewalls and/or other guides that help direct a toy vehicle into or out of a turn. Furthermore, the entrance, exit, and/or curved portion may include a top that at least partially encloses the vehicle path of the corner booster.

In the illustrated example, entrance 20 is on the left side of the corner booster, and exit 22 is on the right side of the corner booster. Such an arrangement directs a toy vehicle through a right-hand turn. It is to be understood that a corner booster can alternatively be configured to direct a toy vehicle through a left hand turn.

Corner booster 16 includes a pivot 30 that allows the angle between the entrance and the exit to be selectively adjusted. In other words, the corner booster can be manipulated so as to turn toy vehicles to varying degrees. FIG. 1 shows corner booster 16 set to approximately 120 degrees. FIG. 1 also uses dashed lines to show corner booster 16 set to approximately 90 degrees and approximately 180 degrees. It is to be understood that corner booster 16 is configured such that the angle between the entrance and the exit can be adjusted to virtually any angle between approximately 90 degrees and approximately 180 degrees. In other words, corner booster 16 has approximately 90 degrees of adjustability. In other embodiments, the corner booster can be adapted for adjustment throughout a larger, smaller, and/or different range of angles, or the corner booster can have a fixed angle that is not adjustable.

Figure 2A:
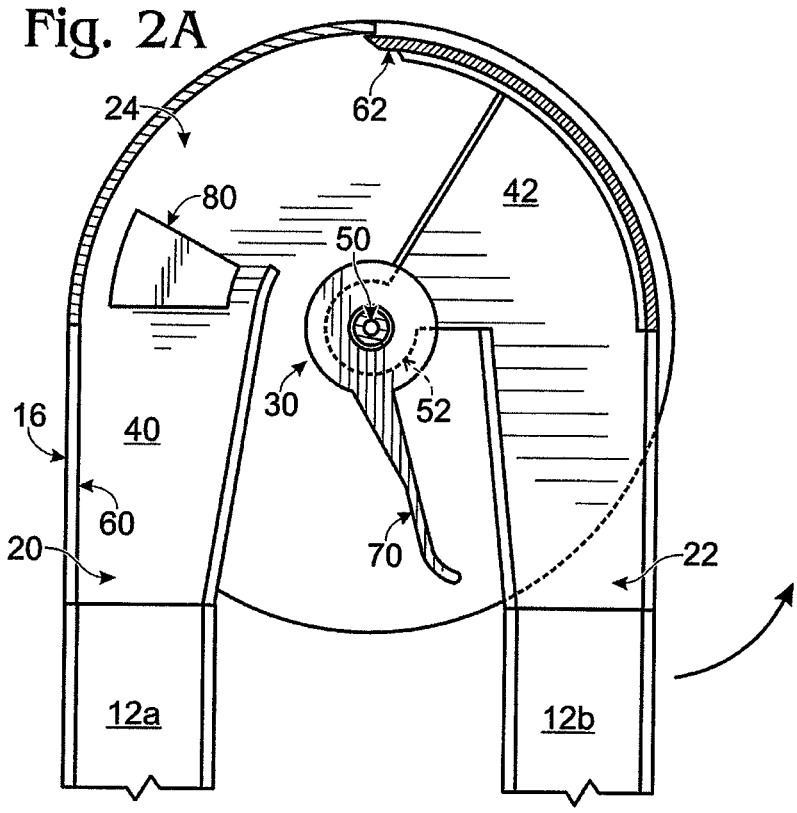
FIG. 2A shows the corner booster of FIG. 1 in a 180 degree configuration.

FIG. 2A shows a cross-sectional top view of booster 16 in a 180 degree configuration. The corner booster includes a base plate 40, which includes entrance 20. The corner booster also includes a variable plate 42, which includes exit 22. As a toy vehicle travels from the entrance to the exit, it first rolls over base plate 40 and then over variable plate 42.

Pivot 30 allows the variable plate to move relative to the base plate. In the illustrated embodiment, pivot 30 includes a central shaft 50 that is in a fixed position relative the base plate. The pivot also includes a guide 52 that is in a fixed position relative the variable plate. Guide 52 is adapted to pivotably engage shaft 50, such that the guide can rotate about the shaft. It is to be understood that other pivoting arrangements are within the scope of this disclosure, and pivot 30 is provided as a nonlimiting example. Although not required, the corner booster may include one or more stops or indicators that assist in setting the corner booster to a desired angle.

In the illustrated embodiment, the variable plate is raised slightly above the base plate. To accommodate a toy vehicle rolling from the base plate onto the variable plate, the variable plate may include a tapered edge, although this is not required. Furthermore, a top cover or interior guide may be used to help maintain control of the toy vehicle as it transitions from the base plate to the variable plate.

The variable plate covers more of the base plate as the angle between the entrance and the exit decreases. In other words, as the corner booster is adjusted to turn toy vehicles at different angles, the variable plate slides over the base plate. This can be appreciated by comparing FIG. 2B to FIG. 2A.

A fixed wall 60 extends upward above the base plate, and a variable wall 62 extends upward above the variable plate. As shown in FIG. 2A, the fixed wall can help guide a toy vehicle through the first portion of a turn when the corner booster is set to a relatively large angle. As the toy vehicle transitions into a second portion of the turn, the variable plate can help guide the toy vehicle.

Figure 2B:
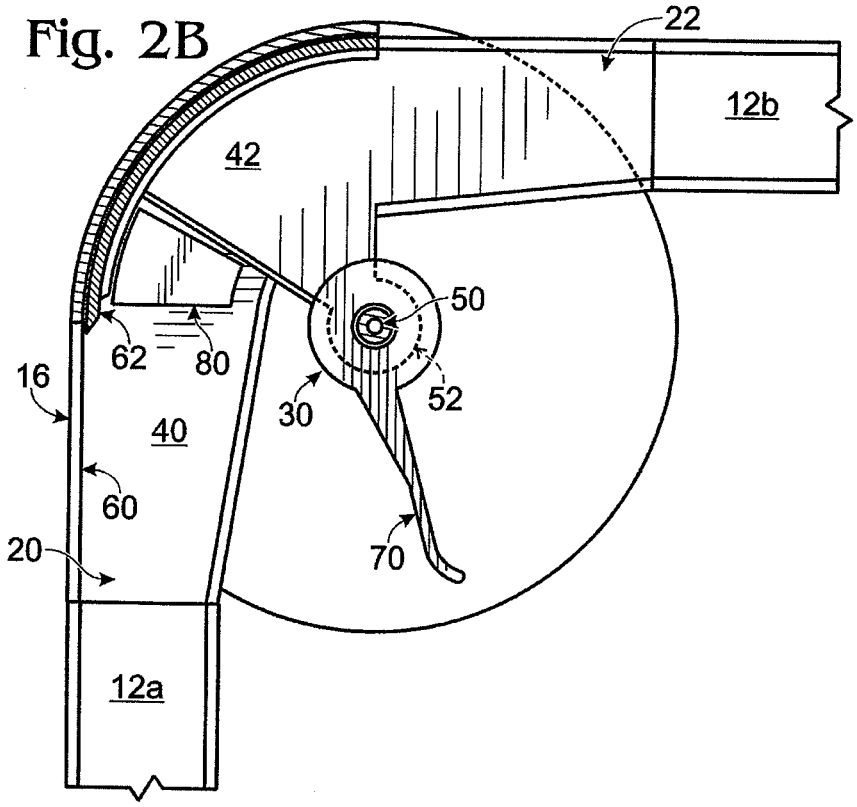
FIG. 2B shows the corner booster of FIG. 1 in a 90 degree configuration.

As shown in FIG. 2B, the variable wall can rotate inside the fixed wall as the angle of the corner booster is decreased. As such, the fixed wall and the variable wall can cooperate to guide a toy vehicle as the corner booster is set at different angles. When the corner booster is set to a 180 degree angle, the fixed wall borders the turn for approximately the first 90 degrees of the turn and the variable wall borders the turn for approximately the last 90 degrees of the turn. When the corner booster is set to a 90 degree angle, the fixed wall is almost completely covered by the variable wall, and thus the variable wall borders nearly the whole turn.

As best shown in FIG. 1, the variable plate portion may be covered by a variable top 66, and the base plate portion may be covered by a fixed top 68. The variable top can slide under the fixed top as the angle of the corner booster is changed. The tops and/or the walls can help guide the toy vehicle around the turn.

In other embodiments, the relative orientation of the entrance and the exit can be fixed. As a nonlimiting example, the angle between the entrance and the exit can be fixed at 180 degrees. Such an arrangement directs a toy vehicle through a complete U-turn so that the vehicle enters the corner booster traveling in one direction and exits the corner booster traveling in the opposite direction. As another example, the angle between the entrance and the exit can be fixed at 90 degrees. Such an arrangement directs a toy vehicle through a right angle turn. As yet another example, the angle between the entrance and the exit can be fixed at 120 degrees. It should be understood that the angle between the entrance and the exit can be fixed at virtually any other angle, including angles less than 90 degrees.

A corner booster can include a booster member that applies a force to a toy vehicle. The applied force can increase the speed of the toy vehicle as the toy vehicle travels from the entrance to the exit of the corner booster. In this way, the corner booster can be used to accelerate a toy vehicle around a corner portion of a track, as opposed to typical boosters that accelerate a toy vehicle along a linear portion of a track.

Figure 3A:
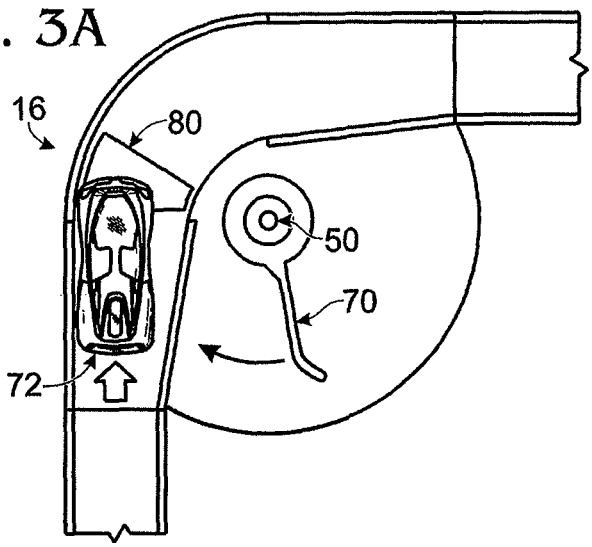
FIGS. 3A, 3B, and 3C show the corner booster of FIG. 1 accelerating a toy vehicle around a 90 degree corner.
Figure 3B:
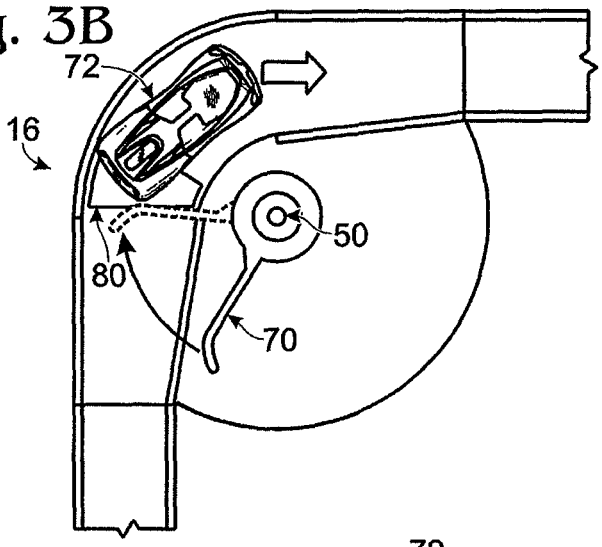
Figure 3C:
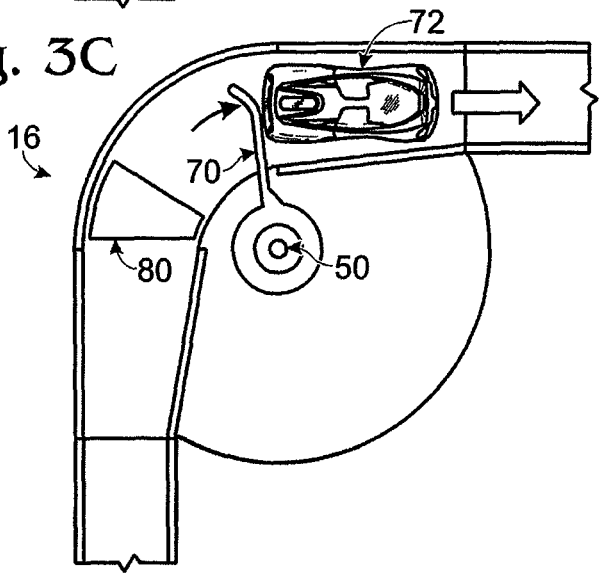

As shown in FIGS. 3A, 3B, and 3C, the booster member can take the form of a paddle 70 that applies an accelerating force to the rear of a toy vehicle 72. In particular, the paddle can rotate in an arc from the entrance to the exit of the corner booster. Although not required, corner booster 16 is configured to rotate paddle 70 in an approximately 360 degree arc every time it is used to accelerate a vehicle around a corner. The axis of paddle rotation can be located along shaft 50. The paddle starts from a resting position that is cocked back away from the entrance so as not to obstruct an incoming toy vehicle. When activated, the paddle quickly rotates behind the incoming toy vehicle. The paddle rotates sufficiently fast so as to catch up to the toy vehicle and push it from behind. The paddle continues rotating around until it comes to rest at its starting position. It is to be understood that paddle 70 is a nonlimiting example of a booster member, which can be used to apply a force to a toy vehicle. In some embodiments, a booster member may include a top that is designed to cover a toy vehicle as it is being boosted, thus helping to maintain control of the toy vehicle and prevent the toy vehicle from being lifted from the surface on which it is rolling.

A variety of different mechanisms can be used to activate the booster member in accordance with the present disclosure. As a nonlimiting example, a trigger can activate the booster member when a toy vehicle travels by the trigger. In the illustrated example, the trigger includes a mechanical leaf switch that can detect when a toy vehicle rolls over a pressure plate 80. The weight of the toy vehicle causes the pressure plate to move in a manner that is detectable by the leaf switch. In other embodiments, the trigger can include an optical motion sensor, a mechanical gate switch, or another device that can activate the booster member.

Although not required in all embodiments, the booster member can be mechanically linked to an electric motor that can quickly spin the booster member up, so as to catch up to a passing toy vehicle and push it from behind. In other embodiments, the booster member may be spring loaded, and the trigger may activate the booster member by causing the spring to release its stored potential energy. In such cases, an electric motor can optionally be used to recharge the spring.

In embodiments that utilize an electric motor, the motor can be battery powered or powered via alternating current from an outlet. As shown in FIG. 1, corner booster 16 includes a motor bay 90 housing a motor under the path of toy vehicle travel. In other embodiments, the motor can be located above the path of toy vehicle travel or to the side of the path of the toy vehicle.

Unlike typical toy vehicle boosters, which continually spin while waiting for a toy vehicle, the herein disclosed corner booster only is activated when a toy vehicle moves into position to be accelerated. This greatly reduces the energy required to operate the booster. Typical toy vehicle boosters may take too long to spin up or spin down to fully utilize the herein disclosed automatic activation system. Furthermore, spinning typical boosters up and down may cause undesired wear and tear on the motor.

However, toy vehicle boosters other than those disclosed herein can be configured to utilize an automatic activation system in accordance with the present disclosure. For example, a more conventional booster can be configured to automatically activate responsive to a toy vehicle traveling by a set trigger point. The distance between the set trigger point and the booster can be selected so that the booster has enough time to spin up. The desirability of such an arrangement is at least partially determined by the speed at which the booster can spin up and spin down.

FIGS. 4-12 show the underside of a corner booster, such as corner booster 16 of FIG. 1. The illustrated corner booster includes a nonlimiting example of a cocking mechanism 100 that cocks a booster paddle so that it can accelerate a toy vehicle 101 around a corner of the corner booster. It should be understood that cocking mechanism 100 can be used with corner boosters other than corner booster 16 of FIG. 1, and that corner booster 16 of FIG. 1 can include a cocking mechanism other than cocking mechanism 100.

Figure 4:
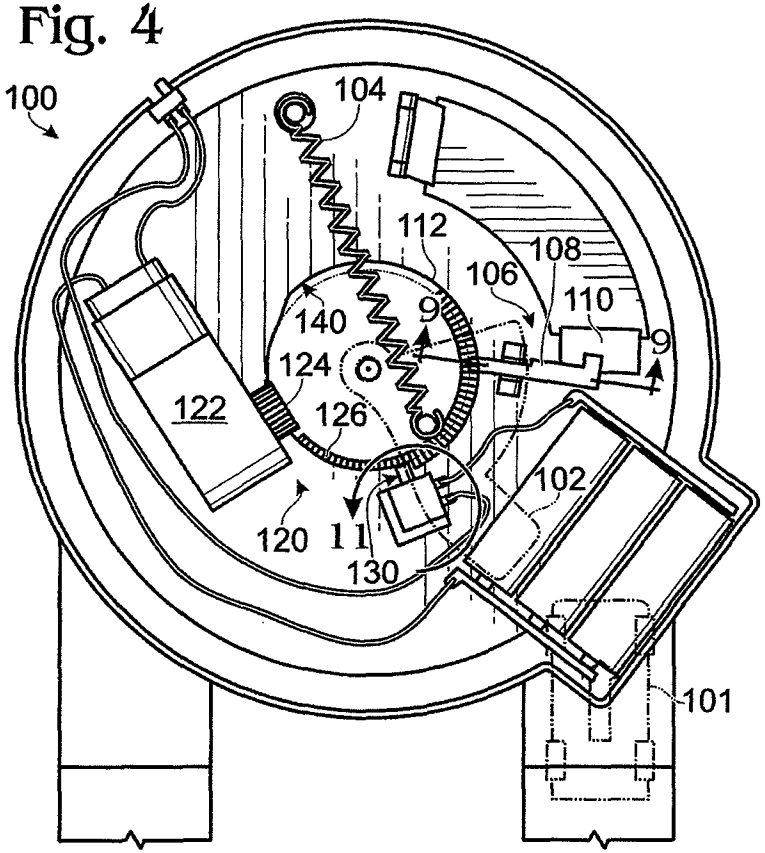
FIG. 4 shows an exemplary cocking mechanism for preloading a booster paddle.

Cocking mechanism 100 is configured to cock a booster paddle 102 in a ready position, as shown in FIG. 4. In the ready position, booster paddle 102 is preloaded by a spring 104 storing mechanical energy. In other words, the spring exerts a force that urges the booster paddle to rotate. A conventional coil spring is illustrated in FIG. 4, although this is not required. A rubber band or virtually any other spring-like member can be used to preload the booster paddle.

A trigger assembly 106 can prevent the paddle from rotating under power from spring 104. Trigger assembly 106 can take virtually any form without departing from the scope of the present disclosure. In the illustrated embodiment, the trigger assembly includes a catch 108 that mechanically links a leaf spring pressure plate 110 to a gear wheel 112. The gear wheel is connected to the booster paddle so that the booster paddle rotates when the gear wheel rotates. In the illustrated embodiment, the booster paddle is coaxial with the gear wheel. Spring 104 is connected between the gear wheel and a stationary anchor, thus urging the gear wheel and the booster paddle into rotation. The catch selectively prevents rotation of the gear wheel and the booster paddle. Such an arrangement is not required. Virtually any mechanical, electrical, magnetic, or other mechanism can be used to selectively prevent rotation of the booster paddle.

Figure 9:
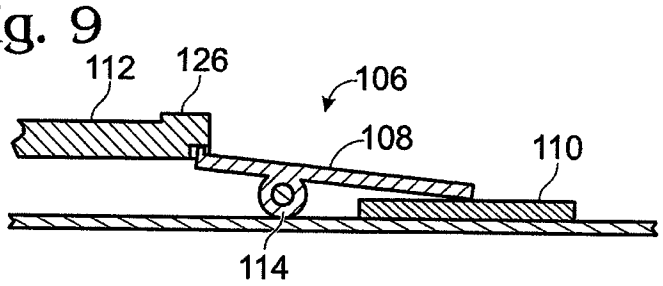
FIG. 9 is a partial cross-sectional view of the trigger assembly of FIG. 4 with a catch in a latching position.
Figure 10:
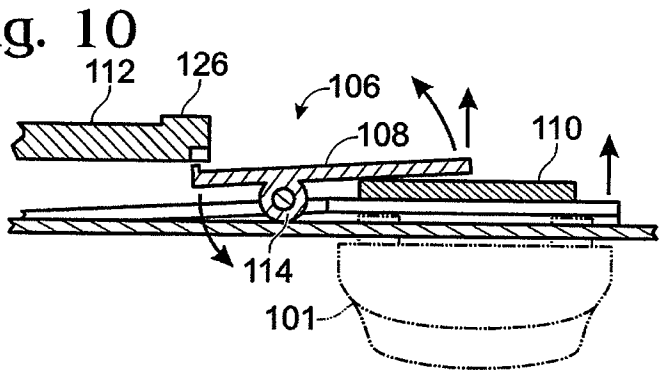
FIG. 10 is a partial cross-sectional view of the trigger assembly of FIG. 5 as the catch is moved to the open position.

In the illustrated embodiment, catch 108 is moveable between a latching position in which it prevents the booster paddle from rotating and an open position in which it does not obstruct rotation of the booster paddle. The latching position is illustrated in FIG. 9, and the open position is illustrated in FIG. 10. In the illustrated embodiment, catch 108 selectively engages a gear wheel 112 that is connected to the booster paddle. When engaged, the catch prevents the gear wheel from rotating, thereby preventing the booster paddle from rotating. When disengaged, the catch does not prevent the gear wheel from rotating, thus allowing the spring to cause the gear wheel and the booster paddle to rotate.

Catch 108 can be moved to the open position by a leaf spring pressure plate 110, thus allowing spring 104 to rotate the gear wheel and the booster paddle. As can be seen in FIG. 9, when in the latching position, catch 108 engages gear wheel 112, thus preventing the gear wheel from rotating. As shown in FIG. 10, when toy vehicle 101 rolls over leaf spring pressure plate 110, the weight of the toy vehicle causes the leaf spring pressure plate to press one end of the catch down so that the catch rotates about a pivot 114 into the open position. The other end of the catch disengages from gear wheel 112. When the catch disengages from the gear wheel, nothing is left to restrict the movement of the booster paddle under the urging of the spring.

Figure 5:
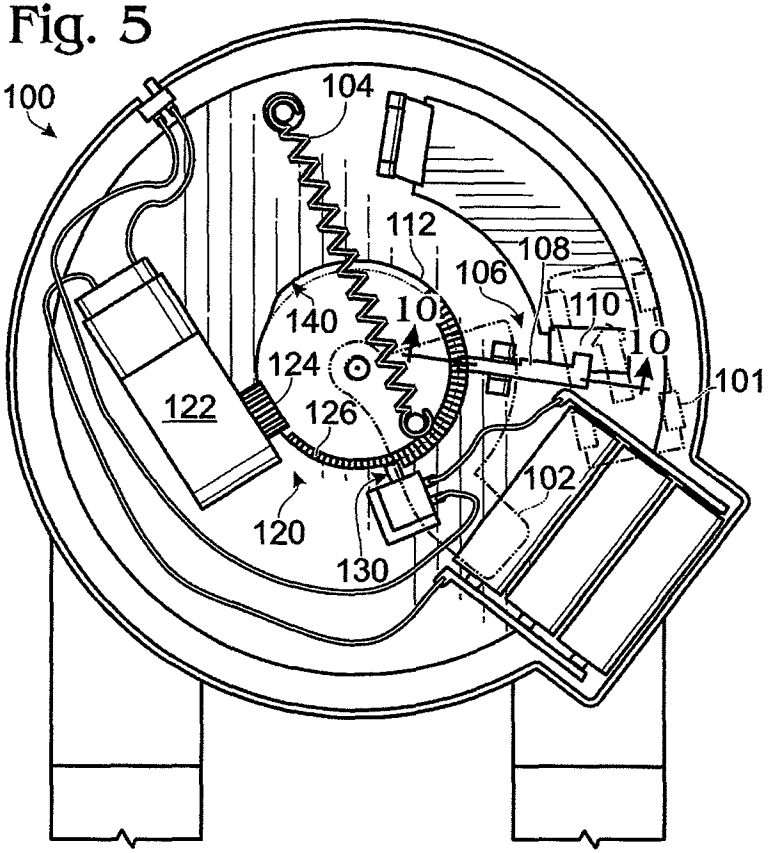
FIG. 5 shows the cocking mechanism of FIG. 4 as a toy vehicle activates a trigger assembly.
Figure 6:
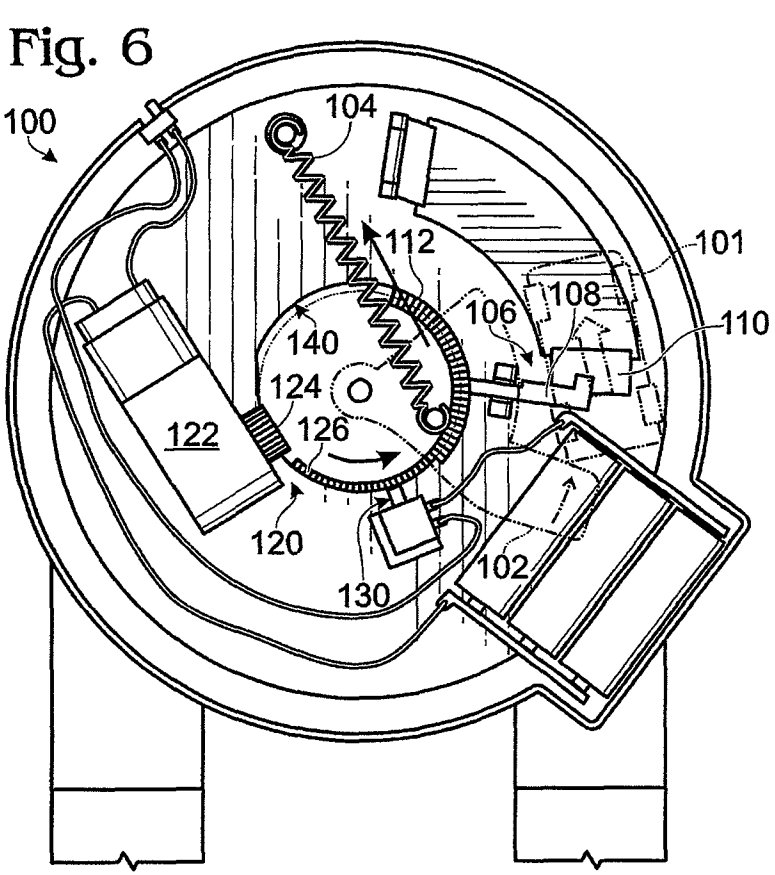
FIG. 6 shows the cocking mechanism of FIG. 4 as the booster paddle is released from the cocked position.

FIG. 5 shows toy vehicle 101 rolling over leaf spring pressure plate 110, thus moving the catch to the open position. As shown in FIG. 6, after the catch moves to the open position, gear wheel 112 and booster paddle 102 are free to rotate under the biasing of spring 104. The spring causes the booster paddle to rotate very rapidly, thus swinging behind toy vehicle 101 and pushing it around the corner, as shown in FIGS. 6-8.

Figure 7:
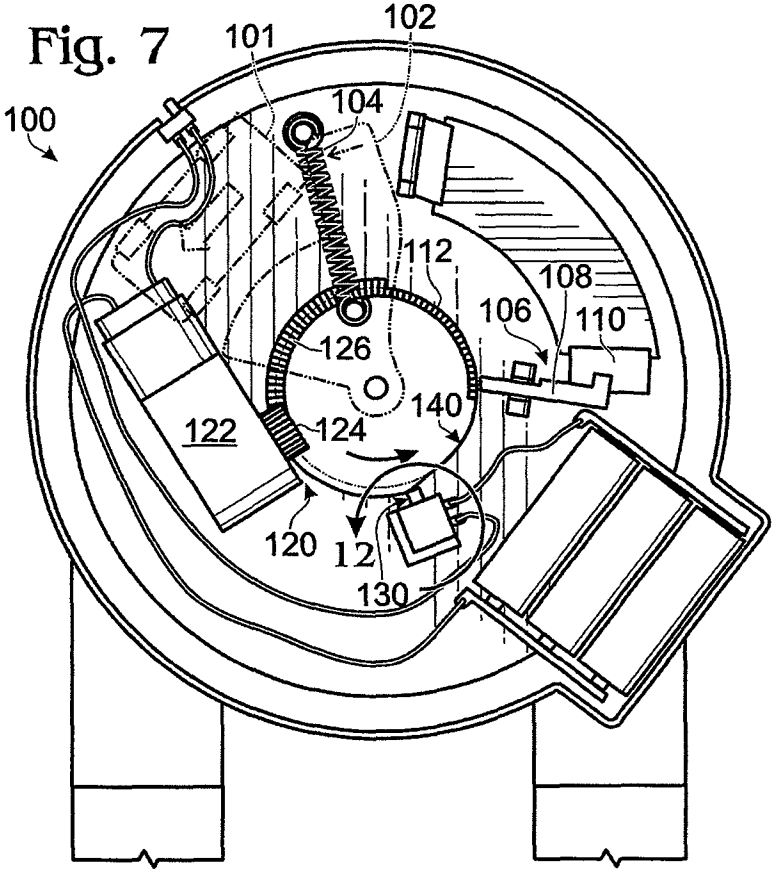
FIG. 7 shows the cocking mechanism of FIG. 4 as the booster paddle accelerates the toy vehicle around a 180 degree corner.
Figure 8:
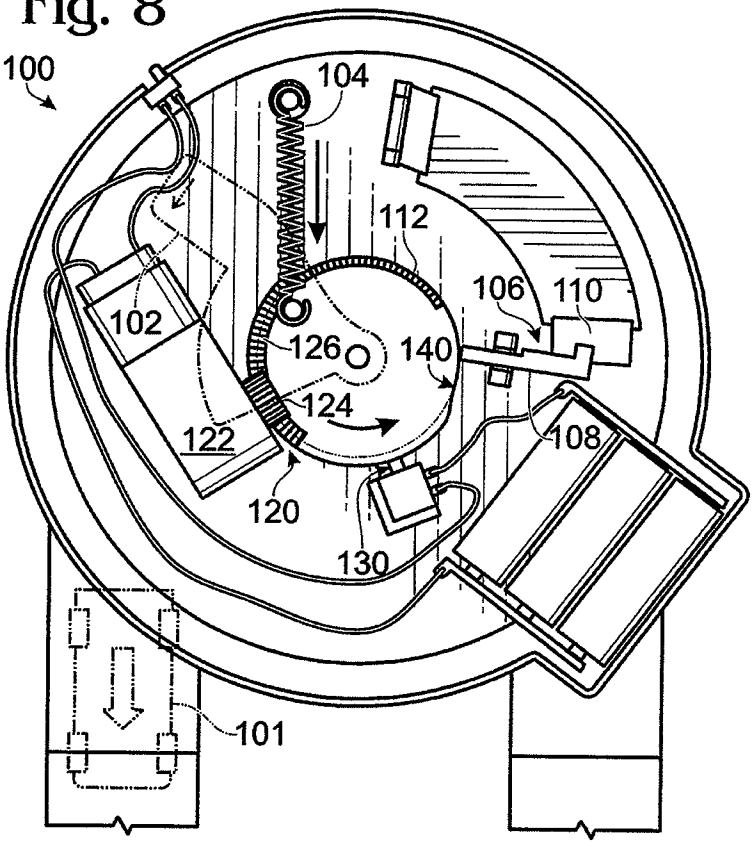
FIG. 8 shows the cocking mechanism of FIG. 4 as the booster paddle is moved back to the cocked position.

In FIG. 7, spring 104 is fully contracted. Once the booster paddle has reached the orientation illustrated in FIG. 7, it no longer rotates under the urging of spring 104. A gear mechanism 120 is used to load spring 104 after it has rotated the booster paddle to the position illustrated in FIG. 7 so that the booster paddle is ready to accelerate the next toy vehicle that enters the corner booster.

Gear mechanism 120 includes an electric motor 122 that turns a drive gear 124. The electric motor can be battery powered, powered via alternating current from an outlet, or powered via another suitable source. The drive gear engages a portion 126 of the gear wheel such that when drive gear 124 rotates, the gear wheel rotates to load spring 104. Portion 126 of the gear wheel includes teeth that are complimentarily configured relative to teeth of the drive gear. However, other arrangements are within the scope of the present disclosure. The drive gear and the gear wheel can be cooperatively configured in virtually any manner that allows the electric motor to rotate the gear wheel.

The gear mechanism rotates the gear wheel and the booster paddle in the same direction that the spring rotates the gear wheel and the booster paddle, although this is not required in all embodiments.

FIGS. 7 and 8 show gear wheel 112 rotating under the power of electric motor 122, which loads spring 104. Once the gear mechanism begins rotation of the gear wheel, it continues to rotate the gear wheel until the spring is in its preloaded position, as shown in FIG. 4.

Figure 11:
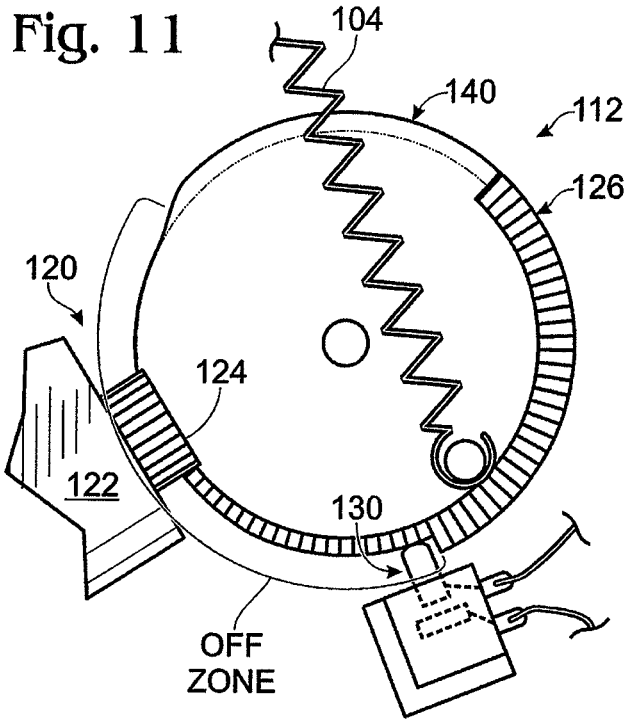
FIGS. 11 and 12 somewhat schematically show the activation assembly of the cocking mechanism of FIG. 4.
Figure 12:
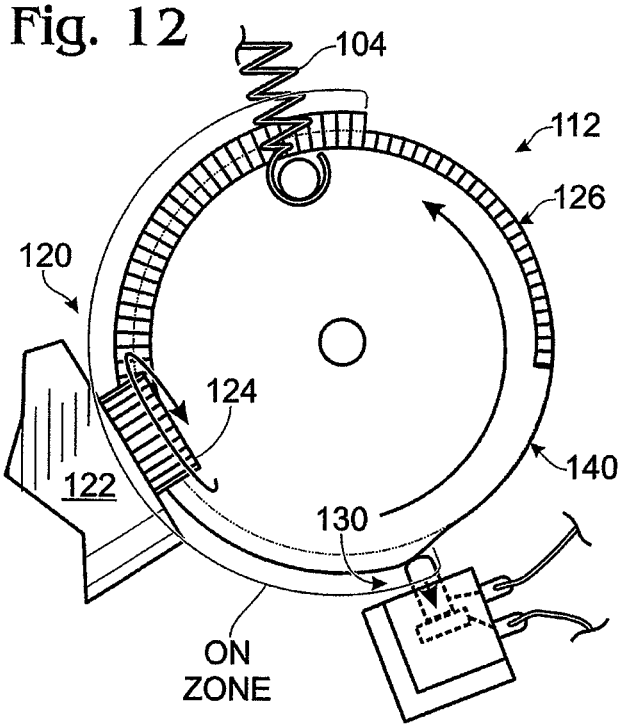

FIGS. 11 and 12 show a nonlimiting example of a mechanism that can be used to turn electric motor 122 on and off so that electric motor 122 only turns drive gear 124 when spring 104 needs to be loaded. In other words, the electric motor automatically turns off when the booster paddle is cocked and the spring is preloaded. In this manner, energy can be saved.

In particular, FIGS. 11 and 12 show a switch 130 that turns electric motor 122 on and off. Gear wheel 112 includes a portion with an extended radius, which can be referred to as the "on zone." The on zone activates switch 130, thus causing the drive gear to rotate the gear wheel. The on zone is sized and positioned to activate the switch at or near the point where spring 104 is fully contracted, as shown in FIG. 12, and to deactivate the switch at or near the point where the spring is preloaded and the trigger assembly has engaged the gear wheel to prevent it from rotating under the power of the spring, as shown in FIG. 11.

The gear wheel also includes a portion with a relatively smaller radius, which can be referred to as the "off zone." The off zone travels by switch 130 without activating the switch when the gear wheel rotates under power from the spring. In this manner, the switch does not impede rotation of the gear wheel and the booster paddle while the booster paddle is accelerating a toy vehicle around the corner.

Gear wheel 112 can include a portion 140 without any gear teeth. This portion can be sized and positioned to correspond to the portion of the gear wheel that travels under the drive gear when the gear wheel is rotated under power from the spring. In this manner, the drive gear does not restrict free rotation of the gear wheel.

While the present invention has been described in terms of specific embodiments, it should be appreciated that the spirit and scope of the invention is not limited to those embodiments. The scope of the invention is instead indicated by the appended claims. All subject matter which comes within the meaning and range of equivalency of the claims is to be embraced within the scope of the claims.

What is claimed is:

1. A toy vehicle track set, comprising:

a track including at least an inbound section and an outbound section; and a corner booster intermediate the inbound section and the outbound section, the corner booster including:

an entrance to which a toy vehicle enters the booster from the inbound section of the track;

an exit from which the toy vehicle exits the booster to the outbound section of the track;

a pivot allowing selective adjustment of an angle between the entrance and the exit; and a booster member for applying a force to the toy vehicle, the force increasing a speed of the toy vehicle as the toy vehicle travels from the entrance to the exit.

2. The toy vehicle track set of claim 1, where the pivot allows the angle between the entrance and the exit to be set at approximately 180 degrees.

3. The toy vehicle track set of claim 1, where the pivot allows the angle between the entrance and the exit to be set at approximately 90 degrees.

4. The toy vehicle track set of claim 1, where the pivot allows the angle between the entrance and the exit to be adjusted throughout a range of approximately 90 degrees.

5. The toy vehicle track set of claim 1, where the booster member applies an accelerating force to a rear of the toy vehicle.

6. The toy vehicle track set of claim 1, where the booster member rotates in an arc from at least the entrance to at least the exit, and where the booster member rotates sufficiently fast so as to push the toy vehicle from behind.

7. The toy vehicle track set of claim 1, further comprising a trigger that activates the booster member when the toy vehicle travels by the trigger.

8. The toy vehicle track set of claim 7, where the booster member remains stationary until activated by the trigger.

9. The toy vehicle track set of claim 7, where the trigger includes a mechanical leaf switch.

10. A corner booster for a toy vehicle track set, comprising:

an entrance to which a toy vehicle enters the booster;

an exit from which the toy vehicle exits the booster;

a pivot allowing selective adjustment of an angle between the entrance and the exit; and a booster member for applying a force to the toy vehicle, the force increasing a speed of the toy vehicle as the toy vehicle travels from the entrance to the exit.

11. The corner booster of claim 10, where the pivot allows the angle between the entrance and the exit to be set at approximately 180 degrees.

12. The corner booster of claim 10, where the pivot allows the angle between the entrance and the exit to be set at approximately 90 degrees.

13. The corner booster of claim 10, where the pivot allows the angle between the entrance and the exit to be adjusted throughout a range of approximately 90 degrees.

14. The corner booster of claim 10, where the booster member rotates in an arc from at least the entrance to at least the exit, and where the booster member rotates sufficiently fast so as to push the toy vehicle from behind.

15. The corner booster of claim 10, further comprising a trigger that activates the booster member when the toy vehicle travels by the trigger.

16. The corner booster of claim 15, where the booster member remains stationary until activated by the trigger.

17. A corner booster, comprising:

an entrance into which a toy vehicle enters the corner booster;

an exit from which the toy vehicle exits the corner booster, where the entrance and the exit are angled such that the toy vehicle turns as the toy vehicle travels from the entrance to the exit;

a pivot that allows selective adjustment of an angle between the entrance and the exit;

a booster member configured to engage the toy vehicle as the toy vehicle travels from the entrance to the exit;

a cocking mechanism for preloading the booster member with stored mechanical energy; and a trigger assembly for holding the booster member in a ready position with stored mechanical energy, wherein the trigger assembly releases the booster member after the toy vehicle moves into the entrance, thereby allowing the stored mechanical energy to rotate the booster member to apply a boosting force to a rear of the toy vehicle as the toy vehicle travels from the entrance to the exit.

18. The corner booster of claim 17, wherein the cocking mechanism includes a spring operatively connected to the booster member and configured to store mechanical energy when the booster member is cocked in the ready position.

19. The corner booster of claim 18, wherein the spring contracts after the trigger assembly releases the booster member from the ready position, and contraction of the spring rotates the booster member to apply the boosting force to the rear of the toy vehicle as the toy vehicle travels from the entrance to the exit.

20. The corner booster of claim 18, wherein the cocking mechanism includes a gear wheel connected to the booster member.

21. The corner booster of claim 20, wherein the trigger assembly includes a catch that engages the gear wheel when the booster member is in the ready position, thereby preventing the gear wheel and the booster member from rotating under force from the spring.

22. The corner booster of claim 21, wherein the booster member includes a pressure plate operatively connected to the catch and configured to disengage the catch from the gear wheel when the toy vehicle rolls over the pressure plate.

23. The corner booster of claim 20, wherein the cocking mechanism includes an electric motor for rotating the gear wheel and the booster member into the ready position against a biasing of the spring, thereby storing mechanical energy in the spring.

24. The corner booster of claim 23, further comprising a switch to selectively activate the electric motor.

25. The corner booster of claim 24, wherein the gear wheel has a portion with an extended radius configured to engage the switch and activate the electric motor.

26. The corner booster of claim 20, wherein the gear wheel is coaxial with the booster member.

27. The corner booster of claim 17, where the pivot allows the angle between the entrance and the exit to be set at approximately 180 degrees.

28. The corner booster of claim 17, where the pivot allows the angle between the entrance and the exit to be set at approximately 90 degrees.

29. The corner booster of claim 17, where the pivot allows the angle between the entrance and the exit to be adjusted throughout a range of approximately 90 degrees.

30. The corner booster of claim 17, where the booster member rotates in an arc from at least the entrance to at least the exit, and where the booster member rotates sufficiently fast so as to push the toy vehicle from behind.

* * * * *